US005339610A

United States Patent [19]

Mondry

[11] Patent Number: 5,339,610

[45] Date of Patent: Aug. 23, 1994

[54] ANTI-THEFT APPARATUS FOR RIDING SADDLES

[76] Inventor: James M. Mondry, 3263 N. Snelling Ave., Arden Hills, Minn. 55112

[21] Appl. No.: 47,926

[22] Filed: Apr. 19, 1993

[51] Int. Cl.[5] ..... B68C 1/20; E05B 73/00

[52] U.S. Cl. ..... 54/1; 70/58

[58] Field of Search ..... 54/1, 44.1; 211/4; 248/552; 47/47 R, 47 L; 70/14, 58, 261

[56] References Cited

U.S. PATENT DOCUMENTS

| | | | |
|---|---|---|---|
| 606,118 | 6/1898 | Bowman . | |
| 1,461,725 | 7/1923 | Cooper . | |
| 2,079,332 | 5/1937 | Overly | 47/47 L |
| 2,425,049 | 8/1947 | Sheridan | 47/47 L |
| 2,983,133 | 5/1961 | Hruby | 70/58 |
| 3,067,846 | 12/1962 | Luebkeman . | |
| 3,636,739 | 1/1972 | Smedley | 70/58 |
| 3,664,163 | 5/1972 | Foote | 70/58 |
| 3,982,413 | 9/1976 | Stone et al. | 60/229 |
| 4,112,716 | 9/1978 | Wippich | 70/49 X |
| 4,167,862 | 9/1979 | Gould | 70/18 |
| 4,426,861 | 1/1984 | Chillis | 70/39 |
| 4,480,450 | 11/1984 | Brown | 70/14 |
| 4,683,729 | 8/1987 | Rogers | 70/58 |
| 4,823,568 | 4/1989 | Rogers et al. | 70/58 |
| 4,907,369 | 3/1990 | Vomfell | 47/47 L |
| 5,238,125 | 8/1993 | Smith | 70/58 X |

*Primary Examiner*—Robert P. Swiatek

*Attorney, Agent, or Firm*—Peterson, Wicks, Nemer & Kamrath

[57] ABSTRACT

An apparatus (10) for preventing theft of riding saddles (12) includes a one-piece, rigid lock device (34) and a padlock (36). The lock device (34) is formed by a finished steel rod having one end bent into a circular shape to form a ring (40) having an extension (42) integrally secured and extending therefrom. The ring (40) is of a size for placement around the saddle horn (16) and for abutment with the saddle body (14). The extension (42) extends through the opening (20) in the saddle body (14) when the ring (40) is received on the saddle horn (16) and adjacent to a bar (28) of a saddle rack (22). A series of apertures (44) are formed in the extension (42) for slideable receipt of the legs of the clasp (38) of the padlock (36). Additionally, the clasp (38) of the padlock (36) extends around the bar (28) of the saddle rack (22) to anchor the lock device (34) to the saddle rack (22). Thus, the anti-theft apparatus (10) of the present invention locks the saddle (12) to the saddle rack (22) to deter theft of the saddle (12).

20 Claims, 1 Drawing Sheet

ANTI-THEFT APPARATUS FOR RIDING SADDLES

BACKGROUND

The present invention generally relates to locking devices, particularly to anti-theft apparatus, and specifically to apparatus for preventing theft of riding saddles or the like.

The problem of the theft of riding saddles has long existed. Additionally, the variety of types, styles, sizes, and manufacture of riding saddles places limitations on the design of the anti-theft device possible which will not unduly hamper the use of the riding saddle. One style of prior anti-theft device for riding saddles utilized some member which locked upon the saddle horn which was then anchored to a remote location by a chain or similar tether device. But such devices suffered from serious shortcomings. Specifically, the chains, or similar tether device, typically were relatively easy to cut by pinchers, bolt cutters or the like which would allow the riding saddle to be stolen (with the horn locking means being removed by the thief at another discreet location). If the chains or similar tether device were made of a size to prevent cutting or making cutting very difficult and/or time consuming, the size and weight of the anti-theft device including the chain or similar tether device would make it difficult for the horse rider to carry the anti-theft device on the horse with the riding saddle. Thus, often the anti-theft device was left at a storage location where the riding saddle was typically stored and not utilized at other remote locations, exposing the riding saddle to the possibility of theft. Additionally, such anti-theft devices were formed of multiple pieces having multiple connection points. The multiple pieces increase the capital costs for manufacturing and assembling the anti-theft device. Additionally, each of the connection points provides a potential breakage point for a thief, allowing unauthorized release of the riding saddle and defeating the desired purpose of the anti-theft device. Due to their shortcomings, prior anti-theft devices generally only act as a partial deterrent to thieves when utilized but are not widely utilized in actual practice and especially not in remote locations and at all times. Thus, a need exists for apparatus for preventing theft of riding saddles or the like of various types, styles, sizes, and manufacture which is simple in construction, having minimum manufacturing and assembly requirements while substantially preventing cutting or breakage of the components and/or their interconnections while being of small size and weight to allow it to be easily carried on the horse with the riding saddle.

SUMMARY

The present invention solves this need and other problems in the field of locking devices by providing, in the most preferred form, a lock member for locking an extension to a saddle rack which is secured to and extends from a member which abuts with a portion of the riding saddle when moved in a first direction and all directions perpendicular thereto while being removable from the riding saddle when moved opposite and generally parallel to the first direction. In a preferred aspect, the abutment means comprises a ring placed on and around the saddle horn integrally .secured to a rigid rod forming the extension, with the ring being formed by bending an end of the rigid rod into a circular shape in the preferred form.

It is thus an object of the present invention to provide a novel apparatus for preventing theft of riding saddles or the like.

It is further an object to provide such a novel anti-theft device which is simple in construction.

It is further an object to provide such a novel anti-theft device which has minimum manufacturing and assembly requirements.

It is further an object to provide such a novel anti-theft device which substantially prevents cutting or breakage.

It is further an object to provide such a novel anti-theft device which is of small size and weight.

It is further an object to provide such a novel anti-theft device which is easy to carry on the horse with the riding saddle.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
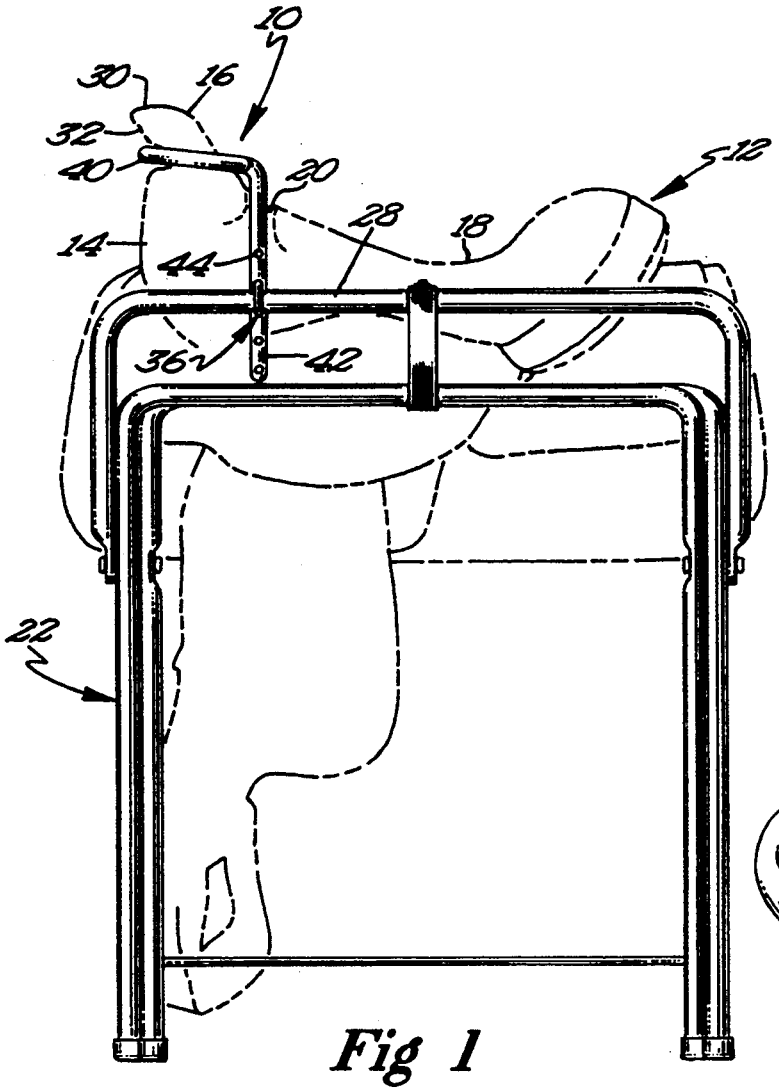
FIG. 1 shows a front view of an anti-theft apparatus for riding saddles or the like according to the preferred teachings of the present invention.
Figure 2:
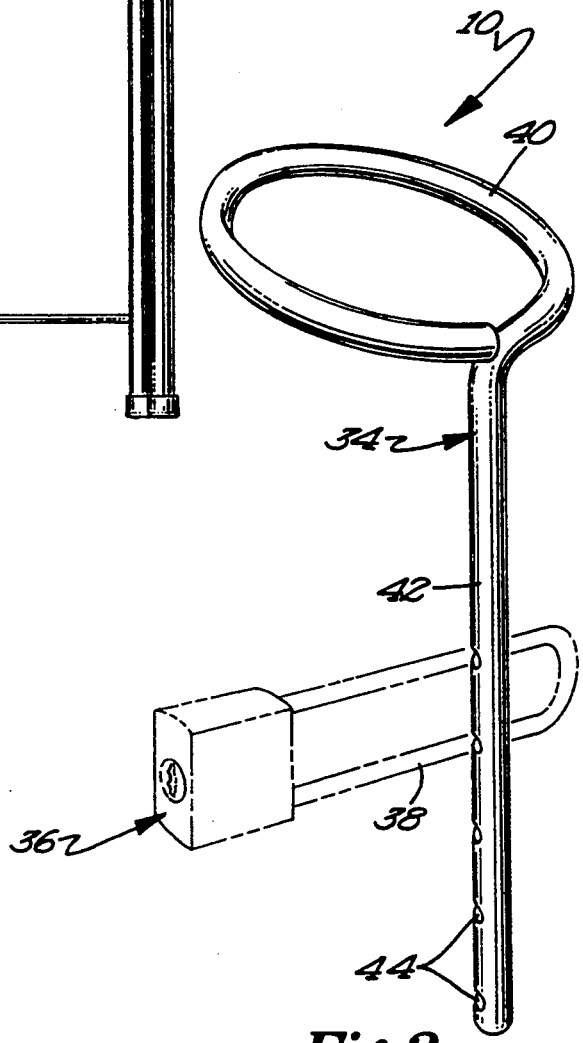
FIG. 2 shows a perspective view of the riding saddle anti-theft apparatus of FIG. 1, with the padlock shown in phantom.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "first", "second", "front", "back", "rear", "upper", "lower", "height", "width", "end", "side", "horizontal", "vertical", and similar terms are used herein, it should be understood that these terms have reference only to the structure shown in the drawings as it would appear to a person viewing the drawings and are utilized only to facilitate describing the invention.

DESCRIPTION

An apparatus for preventing the theft of riding saddles or the like is shown in the drawings and generally designated 10. Generally, anti-theft apparatus 10 according to the preferred teachings of the present invention is utilized for riding saddles 12 including a saddle body or saddle bow 14 having a saddle horn 16 located at the front thereof, such as a western-type shown in the drawings. The saddle 12 further includes a seat 18 supported on the saddle body 14, with an opening 20 defined in the saddle body 14 behind saddle horn 16 and in front of seat 18. In the most preferred form, saddle 12 when not on a horse or the like is stored on a rack 22 of any one of various types of either wood, metal, or other material fabrications and of either a fixed, portable, or folding variety. Rack 22 shown is of the folding type and includes a horizontally arranged, U-shaped bar 28. When being stored, saddle 12 is placed to straddle rack 22 much in the same manner to straddle the horse or the like when in use. Saddle horn 16 extends upwardly from saddle body 14 when saddle 12 is placed upon rack 22 of the form shown. Saddle horn 16 includes a cap 30 and a neck 32 extending between cap 30 and saddle body 14 in a first direction which is vertically downward in the most preferred form shown with saddle 12 supported upon rack 22. Typically, cap 30 has a cross-sectional size which is larger than neck 32.

Anti-theft device 10 according to the preferred teachings of the present invention generally includes a saddle lock device 34 and a padlock 36. Padlock 36 is a purchased part and generally includes a U-shaped clasp 38 having first and second, parallel, spaced legs, with clasp 38 being either of the standard shank length or long shank length which typically is used for locking bicycles or the like.

Device 34 in the most preferred form is of a one-piece, rigid design and specifically is formed by a finished steel rod of a diameter in the range of ½ to ⅝ inch (1.3 to 1.6 cm) and of a length in the range of 10 to 14 inches (25 to 35 cm) and bent at one end into a circular shape having a diameter of 3 to 3½ inches (7.5 to 8.9 cm). Thus, the bent steel rod includes a ring 40 defined by the bent circular shape and an extension 42 integrally, rigidly secured to and extending from ring 40, with extension 42 being formed by the remaining, unbent portion of the rod. In the most preferred form, ring 40 is rigid and of a constant size. Ring 40 is of a size and shape for placement and retention on saddle horn 16. Particularly, ring 40 can be placed on saddle horn 16 by movement relative to saddle horn 16 generally parallel to the first direction which is vertically downward in the most preferred form until and for abutment with saddle body 14 adjacent to saddle horn 16. Saddle horn 16 is located within ring 40 when ring 40 abuts with saddle body 14. Ring 40 is generally located concentrically around and for abutment with saddle horn 16 when moved horizontally or in other words in a direction perpendicular to the first direction. It can be appreciated that ring 40 can be removed from saddle horn 16 when moved relative to saddle horn 16 vertically upward or in other words opposite and generally parallel to the first direction.

Extension 42 in the most preferred form includes a series of axially spaced, diametrically extending, parallel apertures 44, with apertures 44 having a diameter less than extension 42 and for slideable receipt of the legs of clasp 38 of padlock 36. In the most preferred form, apertures 44 are longitudinally spaced along extension 42 generally equal to the spacing between the first and second legs of clasp 38, with the first leg of clasp 38 being slideable in a first of apertures 44 and the second leg of clasp 38 being slideable in a second, adjacent aperture 44.

Now that the basic construction of anti-theft apparatus 10 according to the preferred teachings of the present invention has been explained, one of the preferred manners of use of apparatus 10 and some of its advantages can be set forth and appreciated. Specifically, after saddle 10 has been placed upon rack 22 for temporary or long-term storage, device 34 can be positioned above saddle 10 with ring 40 being horizontal and vertically above saddle horn 16 and with extension 42 extending generally vertically downward and aligned with opening 20. Device 34 can then be moved in the first direction which is vertically downward in the preferred form. Specifically, extension 42 can pass through opening 20 and ring 40 can encircle saddle horn 16. As device 34 is lowered, the free end of extension 42 should be directed to pass adjacent and/or between bar 28 of rack 22. Movement of device 34 can continue until ring 40 abuts with saddle body 14. At that time, the first and second legs of clasp 38 can be positioned to extend generally perpendicular to and on opposite verticalsides of bar 28 and slid into first and second apertures 44. Clasp 38 can then be locked in position by padlock 36. It should then be noted that the first leg of clasp 38 located vertically below bar 28 and slideably received in a first aperture 44 of extension 42 also vertically below bar 28 abuts with bar 28 for preventing device 34 from moving relative to saddle 12 vertically upward or in other words opposite and generally parallel to the first direction. In the most preferred form, the second leg of clasp 38 is located vertically above bar 28 and slideably received in the second aperture of extension 42 also vertically above bar 28 abuts with bar 28 for preventing device 34 from moving relative to saddle 12 vertically downward or in other words in the first direction. Thus, extension 42 and ring 40 are anchored to rack 22 by clasp 38 extending through apertures 44 and abutting with bar 28 of rack 22. As device 34 is prevented from moving relative to saddle 12, it can be appreciated that ring 40 of device 34 is prevented from moving vertically relative to saddle horn 16 in or opposite to the first direction.

It can then be appreciated that saddle 12 is secured to rack 22 and cannot be removed therefrom without removal of padlock 36. Particularly, extension 42 extending through opening 20 and saddle horn 16 located within ring 40 prevents horizontal movement of saddle 12 upon rack 22. Abutment of saddle 12 with rack 22 and with ring 40 of device 34 locked in place on bar 28 of rack 22 prevents vertical movement of saddle 12 upon rack 22. It can then be appreciated that the locking of extension 42 by clasp 38 slideably received in apertures 44 prevents vertical movement of device 34 to prevent removal of ring 40 from saddle horn 16 and to position ring 40 to abut saddle body 14 around saddle horn 16 to prevent vertically upward movement of saddle 12 relative to rack 22. Thus, anti-theft apparatus 10 locks saddle 12 to rack 22 such that to steal saddle 12, it would be generally necessary to take rack 22 along with saddle 12, making portability and concealment much more difficult.

It can then be appreciated that device 34 is of a simple construction, can be quickly fabricated by simply cutting and bending a length of rod and drilling apertures 44 therethrough. The rod forming device 34 is relatively difficult to cut. Additionally, extension 42 can be of a relatively short length, i.e. the vertical distance between bar 28 and saddle body 14 at the attachment point with saddle horn 16 for a typical saddle 12 and a typical rack 22. Thus, device 34 is of a relatively small size and weight which can be easily carried with padlock 36 on the horse such as on the rider's person, in a saddlebag, attached to saddle 12, or otherwise carried by the horse. Additionally, the connection points between device 34 and padlock 36, i.e. aperture 44 and clasp 38 and between clasp 38 in padlock 36 are not prone to breakage allowing unauthorized release of saddle 12. Furthermore, the positioning of device 34 and padlock 36 is generally within the confines of saddles 12, making cutting or breakage thereof difficult. Additionally, the edges of device 34 and padlock 36 are smooth and would not tend to damage saddle 12 when rubbed thereagainst such as when locking saddle 12 to rack 22 or when being carried on the horse as may occur if a chain or similar tether were rubbed against saddle 12.

Now that the basic teachings of the present invention have been explained, many extensions and variations will be obvious to one having ordinary skill in the art. For example, device 34 could be formed from a nickel-plated rod due to the ability of nickel to hold up to ammonia. Additionally, device 34 could optionally include a plastic coating for aesthetic and functional values.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Anti-theft apparatus for riding saddles including a saddle body having a saddle horn with the saddle horn including a cap and a neck extending between the cap and the saddle body in a first direction, with the riding saddle being supported on a saddle rack, comprising, in combination: means movable relative to the saddle horn generally parallel to the first direction for abutment with the saddle body adjacent to the saddle horn when moved in the first direction towards the saddle horn and for abutment with the saddle horn when moved in a direction perpendicular to the first direction and removable from the saddle horn when moved relative to the saddle horn opposite and generally parallel to the first direction; an extension secured to and extending from the abutment means; and means for locking the extension to the saddle rack for preventing the abutment means from moving relative to the saddle horn opposite and generally parallel to the first direction.

2. The anti-theft apparatus of claim 1 wherein the extension is a rigid rod.

3. The anti-theft apparatus of claim 2 wherein the abutment means comprises a ring defined by a periphery of a constant length which can not be opened.

4. The anti-theft apparatus of claim 3 wherein the extension is rigidly secured to the abutment means.

5. The anti-theft apparatus of claim 4 wherein the extension is integrally secured to the abutment means.

6. The anti-theft apparatus of claim 5 wherein the ring comprising the abutment means is formed by bending an end of the rigid rod into a circular shape.

7. The anti-theft apparatus of claim 6 wherein the locking means comprises at least a first aperture formed in the rigid rod.

8. The anti-theft apparatus of claim 7 wherein the locking means further comprises, in combination: first means slideable in the first aperture for abutting with the saddle rack.

9. The anti-theft apparatus of claim 8 wherein the locking means further comprises, in combination: a second aperture formed in the rigid rod; and second means slideable in the second aperture for abutting with the saddle rack on the side opposite the first means.

10. The anti-theft apparatus of claim 9 wherein the locking means further comprises, in combination: a padlock including a U-shaped clasp having the first and second means.

11. The anti-theft apparatus of claim 2 wherein the locking means comprises at least a first aperture formed in the rigid rod.

12. The anti-theft apparatus of claim 11 wherein the locking means further comprises, in combination: first means slideable in the first aperture for abutting with the saddle rack.

13. The anti-theft apparatus of claim 12 wherein the locking means further comprises, in combination: a second aperture formed in the rigid rod; and second means slideable in the second aperture for abutting with the saddle rack on the side opposite the first means.

14. The anti-theft apparatus of claim 13 wherein the locking means further comprises, in combination: a padlock including a U-shaped clasp having the first and second means.

15. The anti-theft apparatus of claim 1 wherein the abutment means is of constant size.

16. The anti-theft apparatus of claim 15 wherein the abutment means comprises a ring defined by a periphery of a constant length which can not be opened.

17. The anti-theft apparatus of claim 1 wherein the abutment means comprises a ring defined by a periphery of a constant length which can not be opened.

18. The anti-theft apparatus of claim 17 wherein the periphery of the ring is rigid.

19. The anti-theft apparatus of claim 1 wherein the locking means comprises means for anchoring the extension to the saddle rack.

20. The anti-theft apparatus of claim 1 wherein the abutment means if formed from a single piece.

* * * * *